US009435150B1

(12) United States Patent
Lawrence

(10) Patent No.: US 9,435,150 B1
(45) Date of Patent: Sep. 6, 2016

(54) WINDOW SASH PIVOT BAR AND METHOD

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 0 days.

(21) Appl. No.: 14/740,905

(22) Filed: Jun. 16, 2015

Related U.S. Application Data

(63) Continuation of application No. 13/804,060, filed on Mar. 14, 2013, now Pat. No. 9,097,061.

(51) Int. Cl.
*E05D 15/00* (2006.01)
*E05D 5/00* (2006.01)
*E05D 7/06* (2006.01)

(52) U.S. Cl.
CPC . *E05D 5/00* (2013.01); *E05D 7/06* (2013.01); *E05D 15/00* (2013.01); *E05D 2700/10* (2013.01); *E05Y 2201/00* (2013.01)

(58) Field of Classification Search
CPC ..... E05D 5/00; E05D 15/00; E05D 7/06; E05D 2700/10
See application file for complete search history.

(56) References Cited

U.S. PATENT DOCUMENTS 4,926,524 A 5/1990 Owens
5,069,001 A 12/1991 Makarowski
5,704,165 A 1/1998 Slocomb et al.
5,829,196 A * 11/1998 Maier ..... E05D 13/08 49/181
5,927,013 A * 7/1999 Slocomb ..... E05D 15/22 49/176
6,058,653 A 5/2000 Slocomb et al.
6,658,794 B1 12/2003 Hansel et al.
6,857,228 B2 2/2005 Kunz et al.
9,097,061 B1 * 8/2015 Lawrence ..... E06B 3/5063
2003/0121207 A1 7/2003 O'Donnell et al.
2004/0206002 A1 * 10/2004 Kunz ..... E05D 13/08 49/181
2004/0206003 A1 * 10/2004 Kunz ..... E05D 13/08 49/181
2007/0209281 A1 * 9/2007 Flory ..... E05B 63/14 49/183

* cited by examiner

*Primary Examiner* — Gregory Strimbu

(74) *Attorney, Agent, or Firm* — Blake P. Hurt; Tuggle Duggins P.A.

(57) ABSTRACT

A pivot bar for a double hung window sash includes an elongated member having a knobbed end for engaging a window jamb or frame. The pivot bar has vertical and horizontal shields for completely covering the first and second apertures formed in the window sash. The pivot bar is "snap-fitted" into the first and second apertures which are formed with a conventional electric drill. The first aperture formed in the side of the sash is less than a complete circle in order for the drill bit to simultaneously form the second aperture in the bottom of the sash.

10 Claims, 6 Drawing Sheets

WINDOW SASH PIVOT BAR AND METHOD

This is a continuation of and claims benefits under prior application Ser. No. 13/804,060 filed 14 Mar. 2013, now U.S. Pat. No. 9,097,061, which is incorporated by reference in its entirety herein.

FIELD OF THE INVENTION

The invention herein pertains to tilt type window sashes and particularly pertains to a pivot bar which can be quickly mounted on-site during window installation.

DESCRIPTION OF THE PRIOR ART AND OBJECTIVES OF THE INVENTION

In recent years a greater demand has been felt for tiltable double hung window sashes. These sashes allow the home owner or others to tilt the sashes inwardly on the window frames for cleaning, maintenance and the like. Such tilt window sashes utilize various mechanisms including axles, rods and the like to provide an axis for rotation. While certain of the prior art devices functioned well in use, the installation and assembly was quite complex and often could not be performed on-site with ordinary work tools.

Thus, in view of the problems and disadvantages associated with current tilting window sashes, the present invention was conceived and one of its objectives is to provide a pivot bar for use on window sashes which can be easily and quickly installed on site.

It is another objective of the present invention to provide a pivot bar which includes a vertical and horizontal shield to completely cover the openings formed in the window sash during installation.

It is still another objective of the present invention to provide a pivot bar which is relatively simple, inexpensive and easy to manufacture.

It is yet another objective of the present invention to provide a pivot bar for a window sash which is durable and will not slip or move in the sash once installed.

It is a further objective of the present invention to provide a pivot bar made from inexpensive polymeric materials or the like.

It is still a further objective of the present invention to provide a method of installing a pivot bar on a window sash.

Various other objectives and advantages of the present invention will become apparent to those skilled in the art as a more detailed description is set forth below.

SUMMARY OF THE INVENTION

The aforesaid and other objectives are realized by providing a pivot bar and method of installation for double hung and other windows which have tilting sashes. Window components are generally manufactured at a factory for assembly and installation in homes and other buildings. Conventional tilt sash windows employ a rod or other mechanical device to allow the sash to pivot. As many windows are usually delivered to an installation site at one time, it is a better method to provide for the window sash and pivot mechanism to be installed at the job site. To accomplish this, a pivot bar as shown herein can be used which includes an elongated member having a distal tapered end and a proximal blunt or knob end. Top and bottom shields attached to the elongated member close and seal the openings formed in the window sash for insertion therein.

During installation, a desired sash is selected for a particular window. An electric drill or similar tool is then used to simultaneously bore an opening in the side and bottom of the sash stile. The opening has a center point slightly above the bottom edge of the stile to allow the drill bit to form an arcuate opening in the side of the stile. This arcuate opening is not fully circular as the bottom portion of the bit is below the stile and simultaneously cuts an opening in the bottom of the sash perpendicular to the side. After the appropriate opening is made, the pivot bar can then be inserted into the opening with the vertical shield sealing the arcuate opening in the stile side while the bottom shield seals the opening along the bottom of the sash. An adhesive or caulk can be applied if necessary for a thorough seal of the shields to the stile and sash. As needed, an additional hole is provided in the bottom shield for use in attachment of the sash with a screw. An identical opening is drilled in the opposite side of the sash and the installation is repeated for a second pivot bar. The installation is quick and easy as the sash pivot bars are placed into grooves on each side of the window jamb and easily slide in place for the necessary tilting action.

DETAILED DESCRIPTION OF THE PREFERRED EMBODIMENTS AND OPERATION OF THE INVENTION

Figure 1:
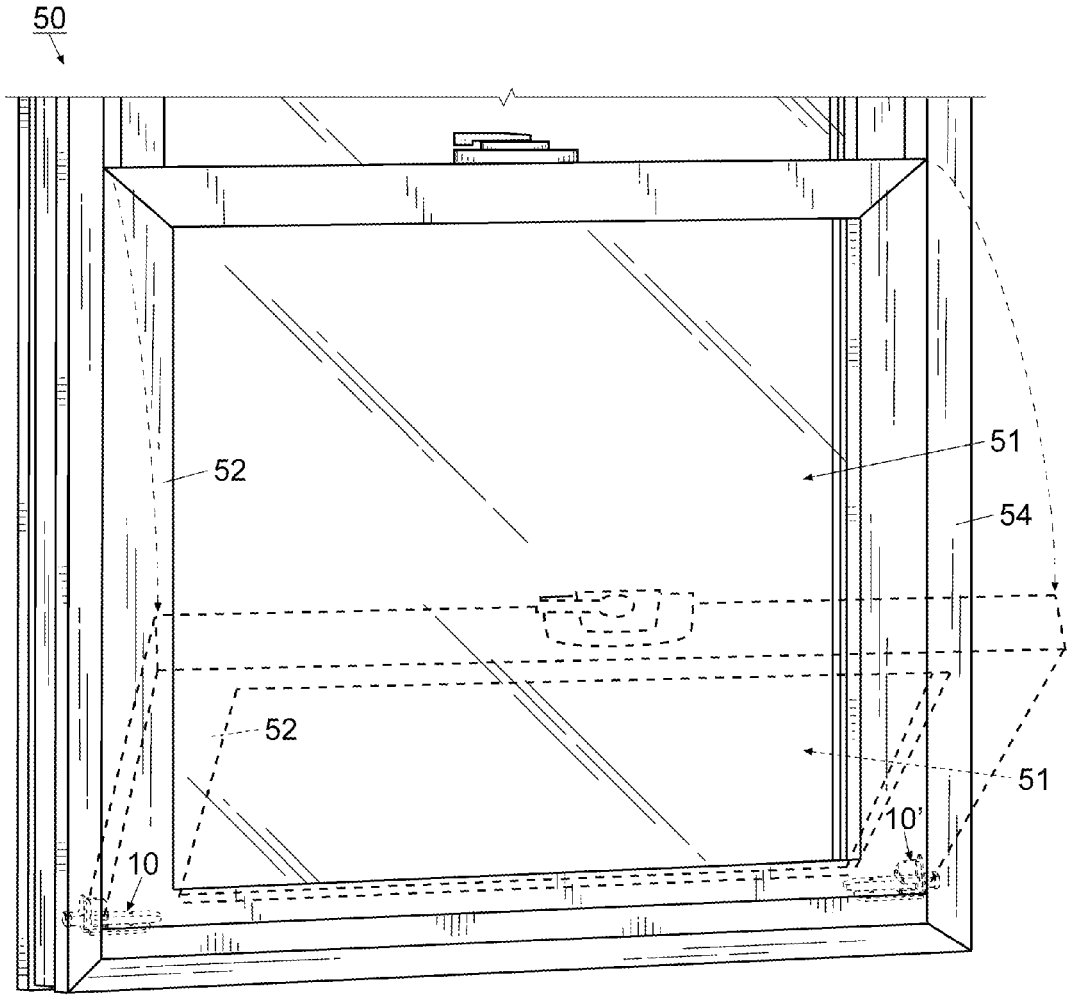
FIG. 1 shows a perspective view of a lower tiltable sash of a double hung window seen in fragmented fashion.
Figure 2:
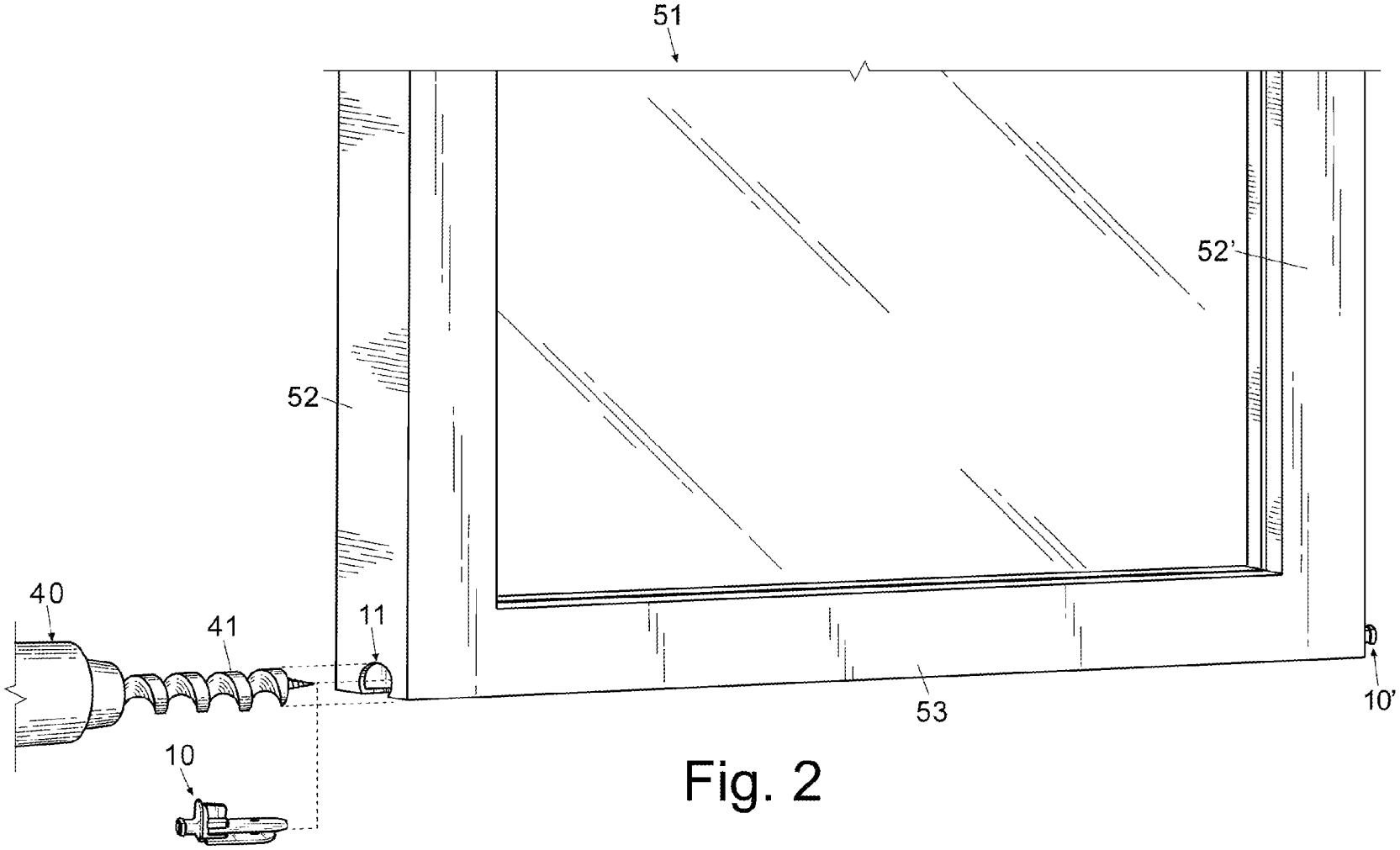
FIG. 2 pictures the sash of FIG. 1 removed from the window frame during schematic pivot bar installation.

For a better understanding of the invention and its method of use, turning now to the drawings, FIG. 1 illustrates a partial conventional double hung window 50 with lower sash 51 shown in both normal (vertical) and tilted (dashed line) positions. To permit tilting, preferred pivot bars 10, 10' as seen in FIG. 2 are employed in stiles 52, 52' of sash 51. In order to install pivot bars 10, 10', FIG. 2 demonstrates schematically, drill 40 which is a standard electric drill having removable bit 41 used to form opening 11. Sash 51 is shown prior to installation in window frame 54 having stiles 52, 52' and sash bottom 53 which as understood are each hollow.

Figure 3:
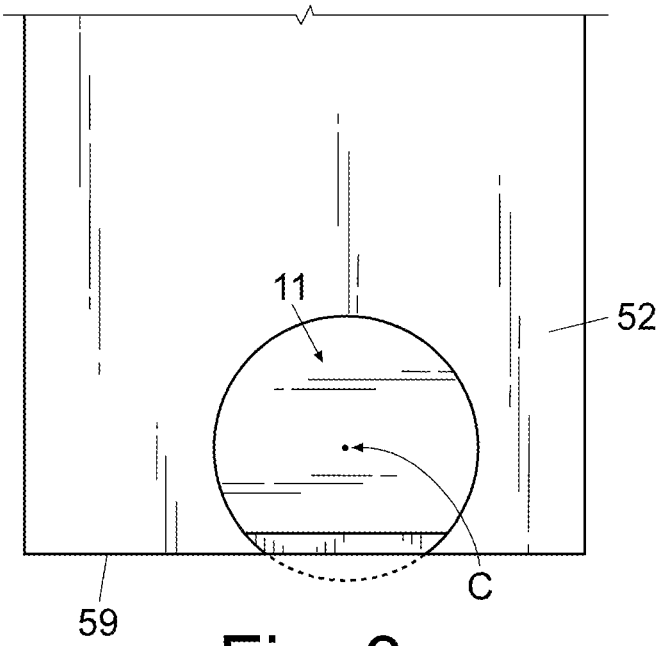
FIG. 3 depicts a partial side elevational view of the stile seen in FIG. 2 with the opening formed for pivot bar insertion.
Figure 4:
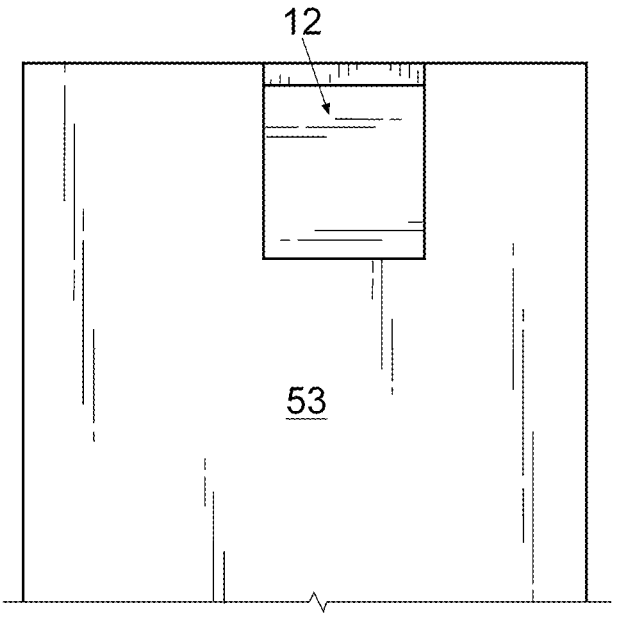
FIG. 4 demonstrates a bottom view of the partial sash seen in FIG. 3.

The method of installation includes the selection of a drill bit 41 which is appropriately sized for use with sash 51 depending on the structural materials such as wood, aluminum or plastics such as polymeric compositions. For example, pivot bar opening 11 as shown in FIGS. 2 and 3 may be for example 13/16 inches in diameter with the width of stile 52 being 1¾ inches. As shown in FIG. 3, opening 11 is not a complete circle as the center C is slightly above the bottom edge 59 of stile 52. By so centering drill bit 41, drill bit 41 simultaneously cuts opening 11 in stile 52 and channel 12 in sash bottom 53 as seen in FIG. 4. In this manner, the front wall of stile 52 and the bottom wall of sash bottom 53 are cut simultaneously for easy installation of preferred pivot bar 10.

Figure 5:
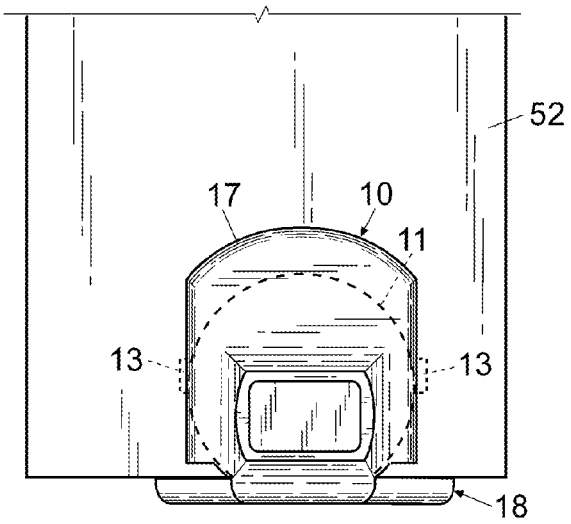
FIG. 5 features an elevational view of the partial stile of FIG. 3 with the pivot bar installed.
Figure 6:
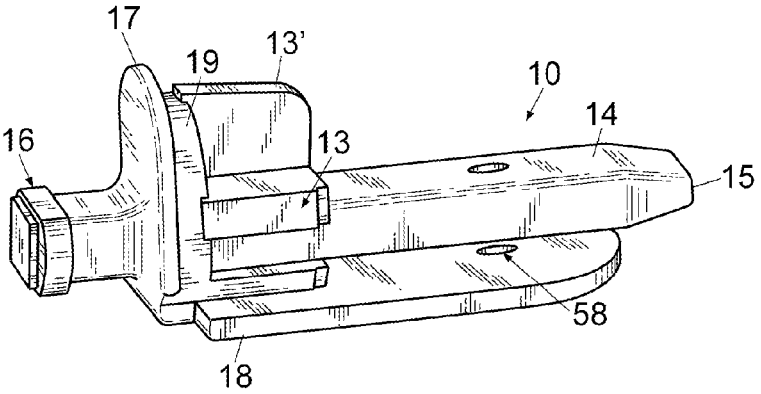
FIG. 6 illustrates a perspective view of the preferred form of the pivot bar.
Figure 7:
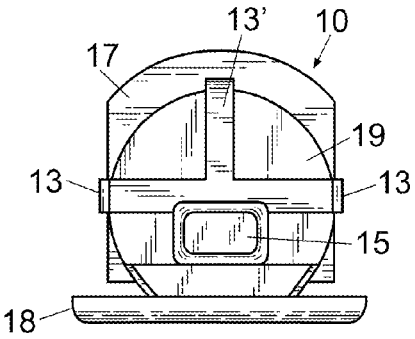
FIG. 7 shows a rear elevational view of the pivot bar seen in FIG. 6.
Figure 8:
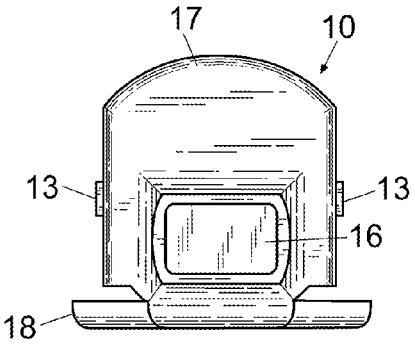
FIG. 8 illustrates a front elevational view of the pivot bar as seen in FIG. 6.
Figure 9:
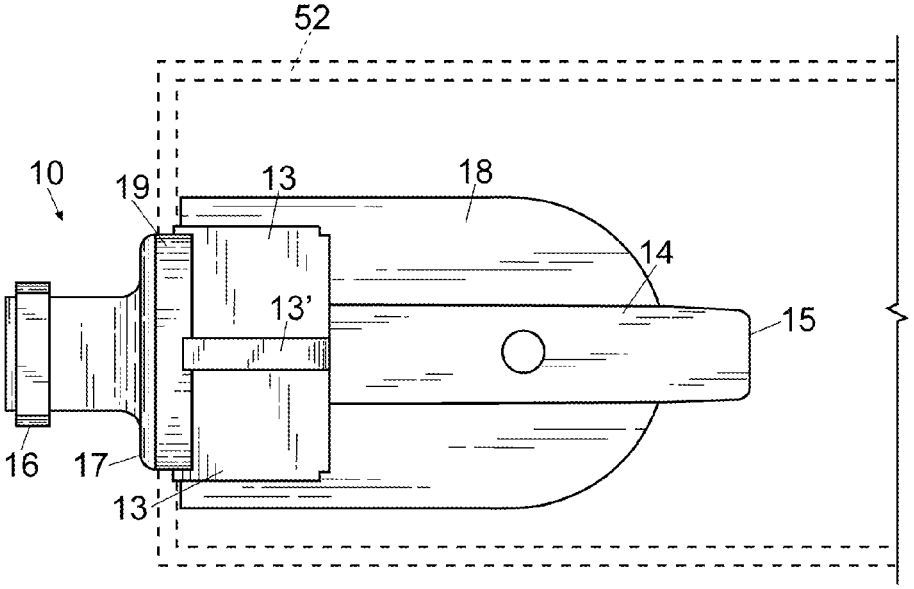
FIG. 9 depicts a top plan view of the pivot bar shown in FIG. 6.
Figure 10:
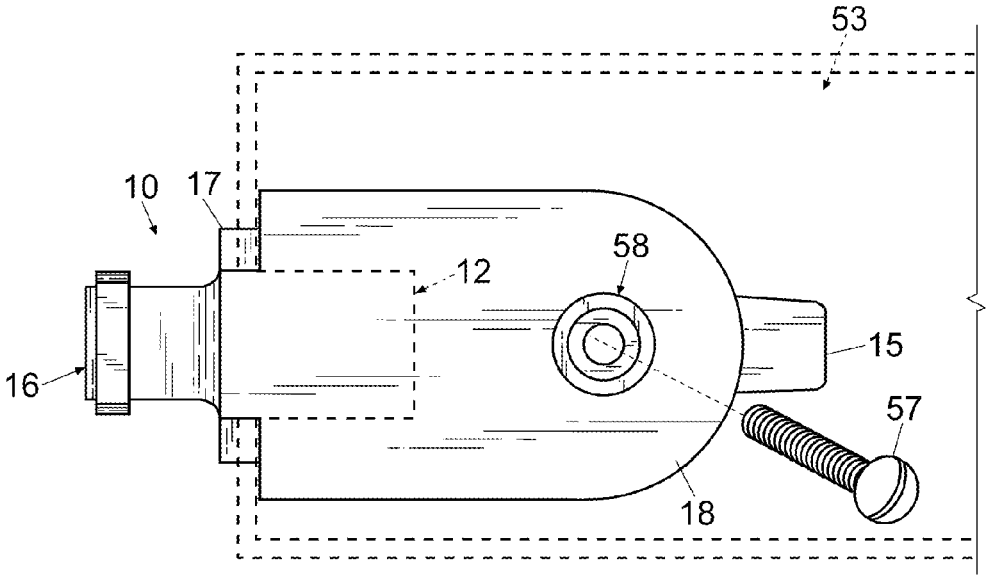
FIG. 10 demonstrates a bottom plan view of the partial sash with the pivot bar as seen in FIG. 6 installed therein.
Figure 11:
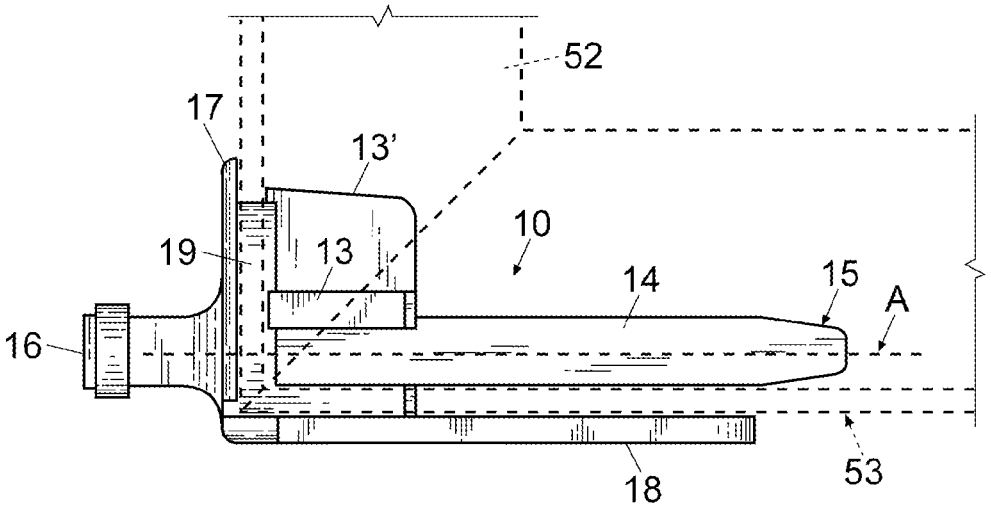
FIG. 11 pictures a cut-away side elevational view of the pivot bar as installed in a window sash.

FIG. 5 demonstrates the installation of preferred pivot bar 10 in opening 11 and channel 12 of sash 51. Pivot bar 10 as shown in FIG. 6 includes longitudinal member 14 having a terminal tapered end 15 with knob 16 (FIG. 7) on the proximal end. Vertical planar shield 17 is positioned perpendicular to longitudinal axis A as seen in FIG. 11 of longitudinal member 14 proximate knob 16 and is affixed to support 19. Horizontal shield 18 is parallel to longitudinal axis A of longitudinal member 14 and is attached to support 19. Support 19 is L-shaped as shown in FIG. 11 and approximates the thickness of the wall thickness of stile 52 as seen in FIG. 11. Vertical shield 17 is U-shaped and sized to completely cover opening 11 in stile 52 whereas horizontal shield 18 has an elongated U-shape and is sized to completely cover channel 12 formed in sash bottom 53 as seen in FIG. 10. Elongated member 14 as seen in FIGS. 8 and 9 further includes horizontal ribs 13 and vertical ribs 13' which extend slightly beyond support 19 as shown in FIG. 11, towards knob 16. Ribs 13, 13' are tapered and are slightly larger than opening 11 to allow them to "snap" into place over the rear of the front wall of stile 52 while tightly securing pivot bar 10 during installation. As would be understood channel 12 as shown in dotted line fashion in FIG. 10 is cut into the bottom wall of sash bottom 53 to allow for placement of support 19 such that elongated member 14 and shield 18 frictionally engage the wall of sash bottom 53 when pivot bar 10 is inserted. Thus elongated member 14 extends into the hollow section of sash bottom 53 and shield 18 extends over the wall of sash bottom 53. A conventional sheet metal screw such as screw 57 can be inserted through opening 58 in horizontal shield 18 as needed to engage the bottom wall of sash bottom 53 for additional structural strength. The same installation process would be performed for installation of pivot bar 10' in stile 52'.

As would be understood, vertical shield 17 and horizontal shield 18 are sized to completely cover respectively opening 11 and channel 12 to prevent dirt, dust or moisture infiltration into respectively stile 52 and sash bottom 53. Pivot bar 10 as seen in FIGS. 5-11 can be easily installed on-site in a window sash using conventional tools by those of relatively low skill. Once both pivot bars 10, 10' are installed, sash 51 can be inserted into a window frame such as window frame 54 whereby knobs 16, 16' (16' not shown) are then placed in preformed slots or grooves in the window jambs as conventional to allow for tilting of sash 51.

While the method of installation shown and described herein is used for a window sash pivot bar the same technique could be used on a window sash for installing other hardware such as tilt latches or other usual window hardware.

The illustrations and examples provided herein are for explanatory purposes and are not intended to limit the scope of the appended claims.

I claim:

1. A method of installing a pivot bar having a vertical shield in a window sash that includes first and second sash stiles attached to opposing ends of a sash bottom, comprising:

forming a first opening in a side surface of the first sash stile at a bottom portion of the first sash stile, the first opening defining an incomplete circular opening in the side surface of the first sash stile, said incomplete circular opening being defined by a radius extending from a center point, wherein said center point is positioned above a bottom edge of the first sash stile;

forming a second opening, the second opening formed in a bottom portion of the sash bottom, the second opening being continuous with the incomplete circular opening of the first sash stile;

inserting the pivot bar into the incomplete circular opening of the first sash stile; and closing the incomplete circular opening of the first sash stile with the vertical shield.

2. The method of claim 1 wherein the step of fondling a second opening comprises forming a rectangular opening in the sash bottom.

3. The method of claim 1 wherein the step of forming a first opening in the side surface of the first sash stile comprises drilling a hole in the side surface of the first sash stile.

4. The method of claim 1 wherein the pivot bar comprises a support attached to the shield.

5. The method of claim 1 further comprising securing the pivot bar to the sash bottom with a fastener.

6. The method of claim 1 whereby the steps of forming the first and second openings are performed by simultaneously drilling into the side surface of the first sash stile and the bottom portion of the sash bottom.

7. A method of installing a pivot bar having first and second longitudinal projections in a window sash that includes first and second sash stiles attached to opposing ends of a sash bottom, comprising:

forming an incomplete circular opening in a side surface of the first sash stile at a bottom portion of the first sash stile, said incomplete circular opening being defined by a radius extending from a center point, wherein the center point is positioned above a bottom edge of the first sash stile;

forming a rectangular opening in a bottom portion of the sash bottom, the incomplete circular opening being continuous with the rectangular opening; and inserting the pivot bar into the incomplete circular and rectangular openings, and seating a portion of the sash bottom between the first and second longitudinal projections.

8. The method of claim 7 wherein the bottom portion of the first sash stile and the bottom portion of the sash bottom form an exterior corner of the window sash.

9. The method of claim 7 wherein the pivot bar includes a vertical shield which completely covers the incomplete circular opening.

10. A method of installing a pivot bar having first and second longitudinal projections and a vertical shield in a window sash that includes first and second sash stiles attached to opposite ends of a sash bottom, comprising:

forming a first opening in a side surface of the first sash stile at a bottom portion of the first stash stile, the first opening defining an incomplete circular opening in the side surface of the first sash stile, the incomplete circular opening being defined by a radius extending from a center point, wherein the center point is positioned above a bottom edge of the first sash stile;

forming a second, rectangular opening in a bottom portion of the sash bottom the second opening continuous with the incomplete circular opening;

inserting the pivot bar into the incomplete circular opening of the first sash stile and the rectangular opening such that a portion of the sash bottom is of the sash bottom inserted between the first and second longitudinal projections and the incomplete circular opening of the first sash stile is closed by the vertical shield.

* * * * *